US007913817B2

(12) United States Patent
Fujimoto et al.

(10) Patent No.: US 7,913,817 B2
(45) Date of Patent: Mar. 29, 2011

(54) OIL PUMP UNIT FOR INTERNAL COMBUSTION ENGINE

(75) Inventors: Yasushi Fujimoto, Saitama (JP); Kinya Mizuno, Saitama (JP); Hiromi Sumi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 582 days.

(21) Appl. No.: 11/902,593

(22) Filed: Sep. 24, 2007

(65) Prior Publication Data

US 2008/0073153 A1 Mar. 27, 2008

(30) Foreign Application Priority Data

Sep. 27, 2006 (JP) ..... 2006-262505

(51) Int. Cl.
*F01M 11/00* (2006.01)
*F01M 1/04* (2006.01)
*F01M 11/03* (2006.01)

(52) U.S. Cl. ..... 184/6.28; 184/6.5

(58) Field of Classification Search ..... 184/6.5, 184/6.28

See application file for complete search history.

(56) References Cited

U.S. PATENT DOCUMENTS

| | | | | |
|---|---|---|---|---|
| 6,024,193 | A * | 2/2000 | Fukushima | 184/6.28 |
| 6,527,087 | B2 * | 3/2003 | Ito et al. | 184/6.5 |
| 7,121,163 | B2 * | 10/2006 | Ito et al. | 74/606 R |
| 2002/0007984 | A1 * | 1/2002 | Ito et al. | 184/6.5 |
| 2007/0068479 | A1 * | 3/2007 | Matsuda | 123/196 R |

FOREIGN PATENT DOCUMENTS

JP 63-76952 A 4/1988

* cited by examiner

*Primary Examiner* — Michael R Mansen
*Assistant Examiner* — Robert T Reese
(74) *Attorney, Agent, or Firm* — Birch, Stewart, Kolasch & Birch, LLP

(57) ABSTRACT

An oil pump unit for an internal combustion engine can reduce the number of component parts to configure a simplified pump case, reducing the size and weight thereof. In an oil pump unit has a case cover put on the outside of a crankcase via a spacer and an oil tank chamber formed by the inside surface of the case cover and the spacer. The spacer is formed inside an outer circumferential wall thereof with a division wall which partitions the oil tank chamber from a crank chamber and with one pump case half-body portion forming a half-body of a pump case of an oil pump. Another pump case half-body is joined to the pump case half-body portion to form the pump case. The pump case half-body portion is formed in a lower portion thereof with an oil suction port communicating with a bottom portion of the oil tank chamber.

4 Claims, 8 Drawing Sheets

OIL PUMP UNIT FOR INTERNAL COMBUSTION ENGINE

CROSS-REFERENCE TO RELATED APPLICATIONS

This nonprovisional application claims priority under 35 U.S.C. §119(a) on Patent Application No. 2006-262505, filed in Japan on Sep. 27, 2006, the entirety of which is incorporated herein by reference.

BACKGROUND OF THE INVENTION

1. Field of the Invention

The present invention relates to an oil pump unit for an internal combustion engine.

2. Background of the Invention

There is a case where an internal combustion engine is provided with an oil pump that is disposed in an engine case constituting an oil storage portion so as to improve the oil suction efficiency of the pump (see, for example, Japanese Patent Laid-open No. Sho 63-76952).

A lubricating device of the internal combustion engine disclosed in Japanese Patent Laid-open No. Sho 63-76952 is of a dry sump type and is such that an oil pump unit including respective united pump cases of a scavenging pump and a feed pump is disposed in a clutch chamber whose bottom portion serves as an oil storage portion.

The oil pump unit is configured differently from an engine case constituting the clutch chamber and is installed in the clutch chamber in such a manner that the pump case itself is provided with an oil intake port adapted to suck the oil collecting in the oil storage portion by the drive of the pump, and with an oil discharge port and the like.

Thus, the oil pump unit configured differently from the engine case is increased in the number of the component parts so that the pump case tends to be configured in a complicated manner to increase in size as well as in weight.

SUMMARY OF THE INVENTION

In view of the foregoing, the present invention has been made and it is an object of the invention is to provide an oil pump unit for an internal combustion engine that can reduce the number of component parts, configure a pump case simply so as to be reduced in size and in weight.

To achieve the above object, according to a first aspect of the present invention, an oil pump unit for an internal combustion engine in which a case cover is put on the outside of a crankcase via a spacer and an oil tank chamber is formed by the inside surface of the case cover and the spacer, the spacer is formed inside an outer circumferential wall thereof with a division wall which partitions the oil tank chamber from a crank chamber and with a pump case half-body portion which is a portion of a pump case for an oil pump, a pump case half-body is joined to the pump case half-body portion to form the pump case, and the pump case half-body portion is formed in a lower portion thereof with an oil suction port communicating with a bottom portion of the oil tank chamber.

According to a second aspect of the present invention, the pump case half-body portion of the spacer is integrally formed with a pump discharge oil passage, which allows the oil pump to communicate with an oil filter.

According to a third aspect of the present invention, the pump case half body is used as a partition plate, the pump case half-body portion of the spacer is joined to one lateral surface of the partition plate to form the pump case of the oil pump, a second pump case half-body is joined to the other lateral surface of the partition plate to form a second pump case of a second oil pump, a portion of the pump case half-body which forms the second pump case together with the second pump case half-body and which protrudes from the pump case half-body portion is bored with a second oil pump discharge port of the second oil pump; and the division wall of the spacer is formed with a tank supply port communicating with the second oil pump discharge port.

According to the first aspect of the present invention, the spacer interposed between the crankcase and the case cover is integrally formed inside the outer circumferential wall thereof with the division wall which partitions the oil tank chamber from the crank chamber and with the pump case half-body portion forming the half-body of the pump case for the oil pump. Thus, the number of component parts of the oil pump unit can be reduced.

The pump case half-body portion of the spacer is formed in its lower portion with the oil suction port communicating with the bottom portion of the oil tank chamber. Thus, a connection pipe, a knock pin, an O-ring, etc. are not needed to simplify the suction oil passage of the oil pump from the oil tank chamber, simplifying the configuration of the pump case. Consequently, the oil pump unit can be reduced in size and in weight.

According to the second aspect of the present invention, the pump case half-body portion of the spacer is integrally formed with the pump discharge oil passage, which allows the oil pump to communicate with the oil filter. Thus, the number of component parts of the oil pump unit can further be reduced.

According to the third aspect of the present invention, the pump case half-body is shared as a division plate, an oil pump is formed on one lateral surface of the division plate and a second oil pump is formed on the other lateral surface thereof. Thus, the number of component parts of the oil pump unit can be reduced.

A portion of the pump case half-body as the partition plate, which protrudes from the pump case half-body portion, is bored with a second oil pump discharge port of the second oil pump. The division wall of the spacer is formed with the tank supply port communicating with the second oil pump discharge port. Thus, the discharge oil passage from the second oil pump to the oil tank can be reduced in the number of component parts thereof to simplify its configuration.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
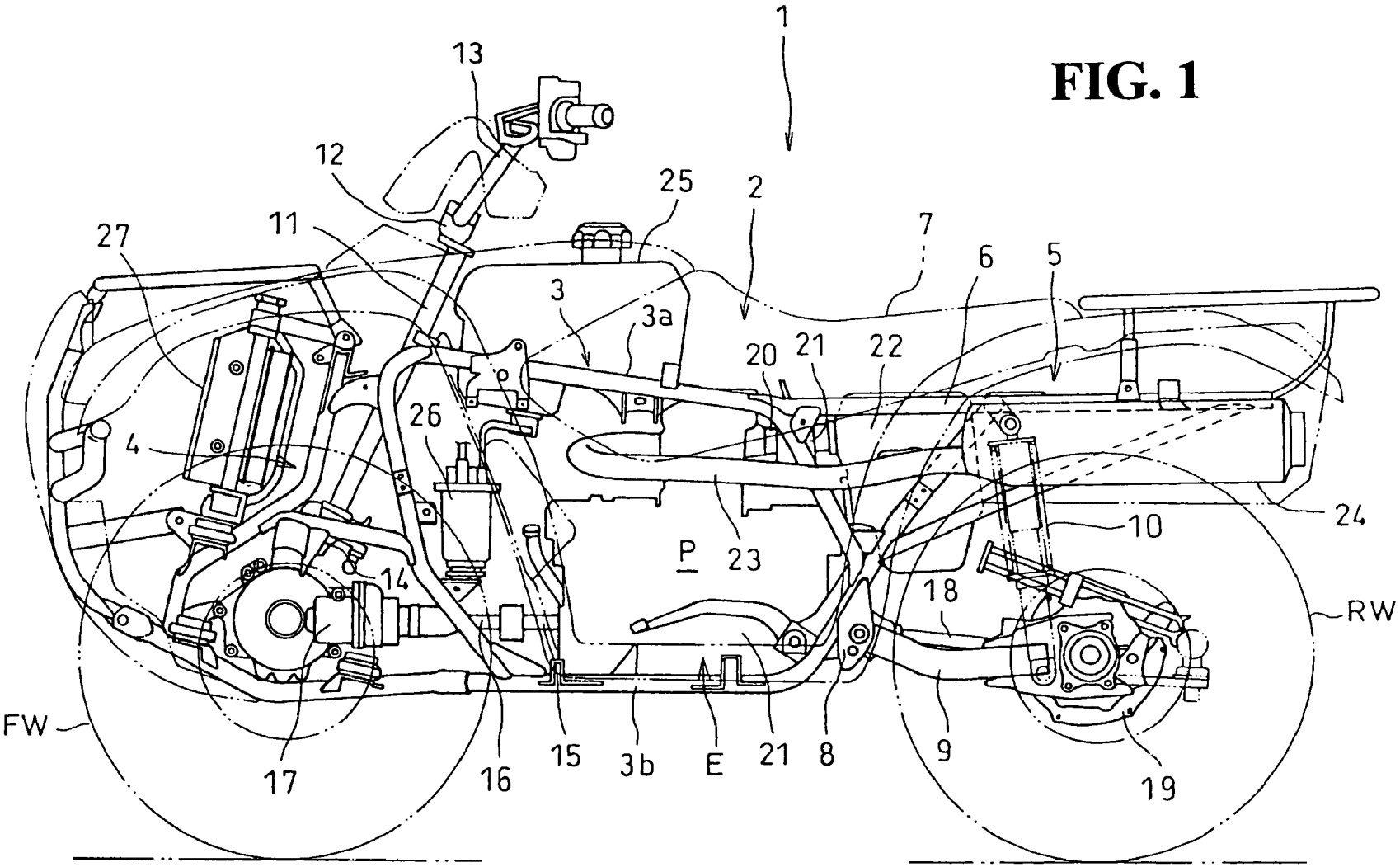
FIG. 1 is a lateral view of an all terrain vehicle on which a power unit is mounted according to an embodiment of the present invention with a body cover and the like removed.

The present invention will now be described in detail with reference to the accompanying drawings, wherein the same reference numerals will be used to identify the same or similar elements throughout the several views. It should be noted that the drawings should be viewed in the direction of orientation of the reference numerals.

An embodiment of the present invention will hereinafter be described with reference to FIGS. 1 through 8.

Figure 2:
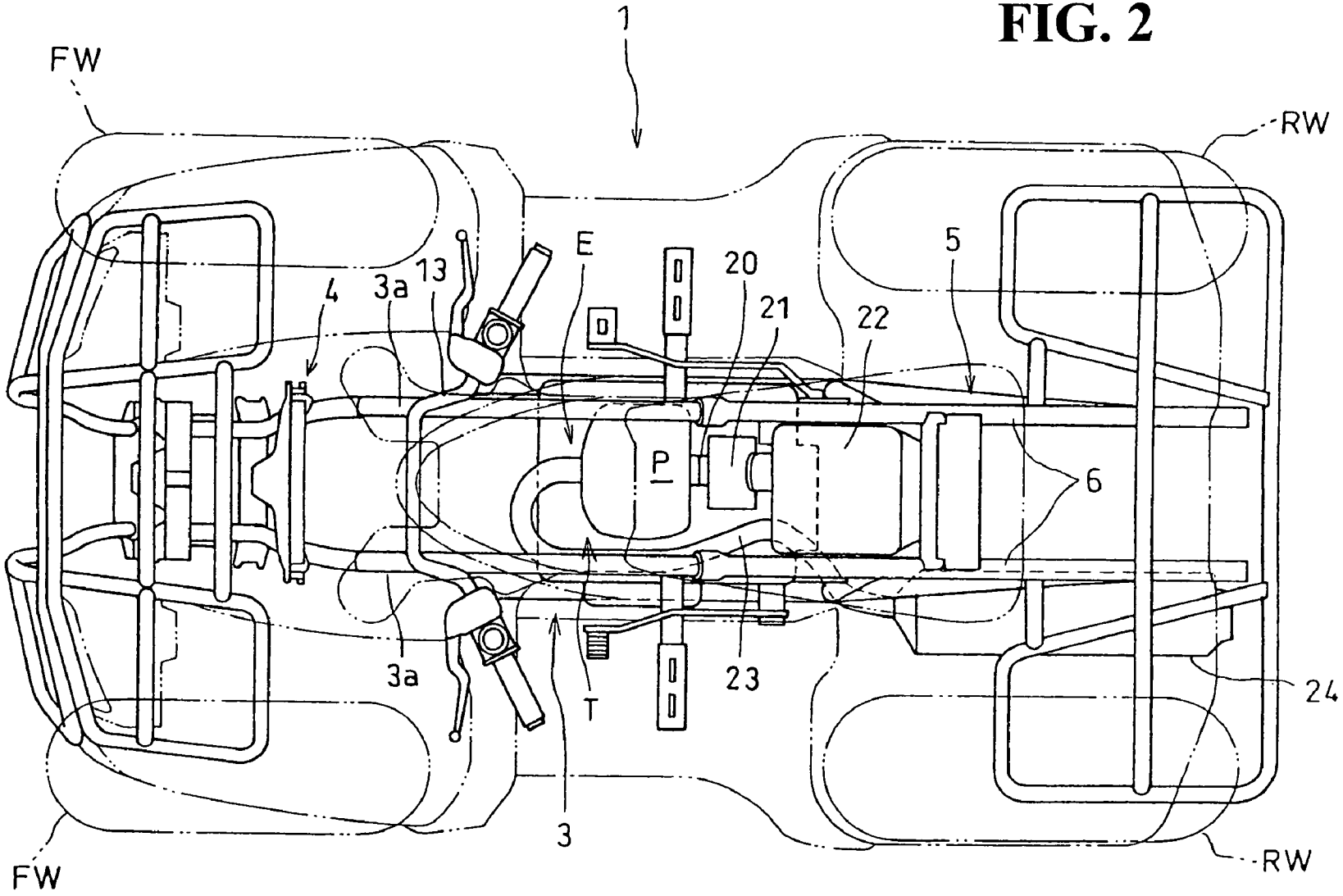
FIG. 2 is a plan view of the vehicle.

FIG. 1 is a lateral view of an all terrain vehicle 1 on which a water-cooled internal combustion engine E according to the embodiment is mounted with a body cover or the like thereof removed. FIG. 2 is a plan view of FIG. 1.

It is to be noted that "the front", "the back or rear", "the right", and "the left" are determined based on the vehicle facing the direction of forward travel in this embodiment.

The all terrain vehicle 1 is a saddle-ride type four-wheeled vehicle and includes a pair of left and right front wheels FW and a pair of left and right rear wheels RW which are suspended by the front portion and rear portion, respectively, of a body frame 2. Irregular ground-purpose lower pressure balloon tires are attached to the front wheels FW as well as to the rear wheels RW.

A body frame 2 is constructed by connecting a plurality of kinds of steel materials and includes a center frame portion 3, a front frame portion 4 and a rear frame portion 5. The center frame portion 3 mounts thereon a power unit P integrally composed of an internal combustion engine E and a transmission T in a crankcase 31. The front frame portion 4 is joined to the front portion of the center frame portion 3 and suspends the front wheels WF. The rear frame portion 5 is connect to the rear portion of the center frame portion 3 and includes seat frames 6 supporting a seat 7.

The center frame portion 3 is formed almost-rectangular as viewed laterally by connecting a pair of left and right upper pipes 3*a* each having front and rear parts bending downward to provide almost three sides, with a pair of left and right lower pipes 3*b* each providing the remaining one side. In addition, the left and right pipes are connected by cross members.

The lower pipe 3*b* bends and extends obliquely upwardly to form its rear portion to which a pivot plate 8 is fixedly connected. A swing arm 9 is swingably connected at its front end to the pivot plate 8. A rear cushion 10 is interposed between the rear portion of the swing arm 9 and the rear frame portion 5. A rear final reduction gear unit 19 is attached to the rear end of the swing arm 9. The rear final reduction gear unit 19 suspends the rear wheel RW.

A steering column 11 is supported by a widthwise-central portion of a cross member spanned between the front ends of the left and right upper pipes 3*a*. The steering column 11 steerably supports a steering shaft 12. Steering handlebars 13 are joined to the upper end portion of the steering shaft 12, which is connected at its lower end to a front wheel steering mechanism 14.

The internal combustion engine E of the power unit P is a water-cooled single-cylinder 4-stroke internal combustion engine. This engine is mounted on the center frame portion 3 in the so-called longitudinally mounted posture with a crankshaft 30 oriented in the back and forth direction of the vehicle body.

The transmission T of the power unit P is disposed in a transmission chamber M on the left side (the right side in FIG. 3) of the crank chamber C rotatably supporting the crankshaft 30 of the internal combustion engine E. An output shaft 15 projects forward and rearward from the transmission T close to the left side of the crank chamber C so as to be oriented in the back and forth direction. The rotational power of the output shaft 15 is transmitted from the front end of the output shaft 15 through a front drive shaft 16 and a front final reduction gear unit 17 to the left and right front wheels FW. In addition, the rotational power is transmitted to the left and right rear wheels RW through a rear drive shaft 18 and the rear final reduction gear unit 19.

The internal combustion engine E is erected so as to slightly slant leftwardly by putting a cylinder block 32, a cylinder head 33 and a cylinder head cover 34 on a crankcase 31 in this order.

An air intake pipe 20 extends rearward from the cylinder head 33 and is connected to an air cleaner 22 via a throttle body 21. An exhaust pipe 23 extends forward from the cylinder head 33, bending leftward, extending rearward and passing by the left side of the air cleaner 22, and connects with an exhaust muffler 24.

A fuel tank 25 is supported above the power unit P by the center frame portion 3 of the body frame 2. A fuel pump 26 is disposed below the front portion of the fuel tank 25. The front frame portion 4 of the body frame 2 supports a radiator 27.

The crankcase 31 forms the crank chamber C and transmission chamber M of the power unit P. In addition, the crankcase 31 has a front-rear-split structure composed of a front crankcase 31F and a rear crankcase 31R which are divided back and forth along a plane perpendicular to the crankshaft 30 which extends along the central axis of the cylinder bore of the cylinder block 32 and is oriented in the back and forth direction of the vehicle body.

Figure 3:
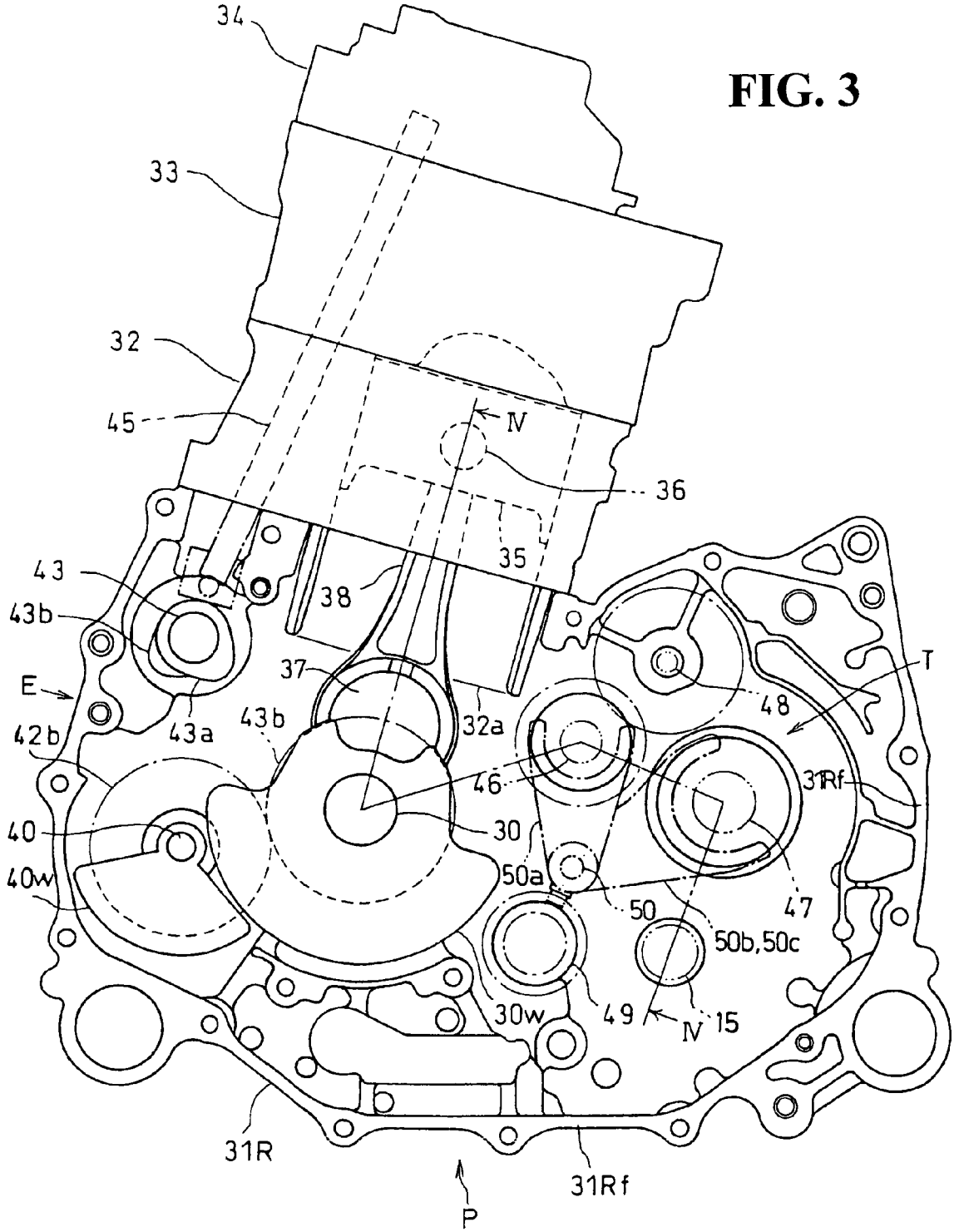
FIG. 3 is a front view of the power unit with an internal combustion engine partially omitted.

FIG. 3 is a front view of the power unit P, illustrating a mating surface 31Rf of the rear crankcase 31R with the internal combustion engine E partially omitted. A cylinder sleeve 32*a* extends into the crankcase 31 from the cylinder block 32 in a fitting manner. A piston 35 is slidably fitted into the cylinder sleeve 32*a*. A crank pin 37 is spanned between a pair of front and rear crank webs 30*w*, 30*w* of the crankshaft 30. The crank pin 37 and a piston pin 36 attached to the piston 35 are connected by a connecting rod 38.

Figure 4:
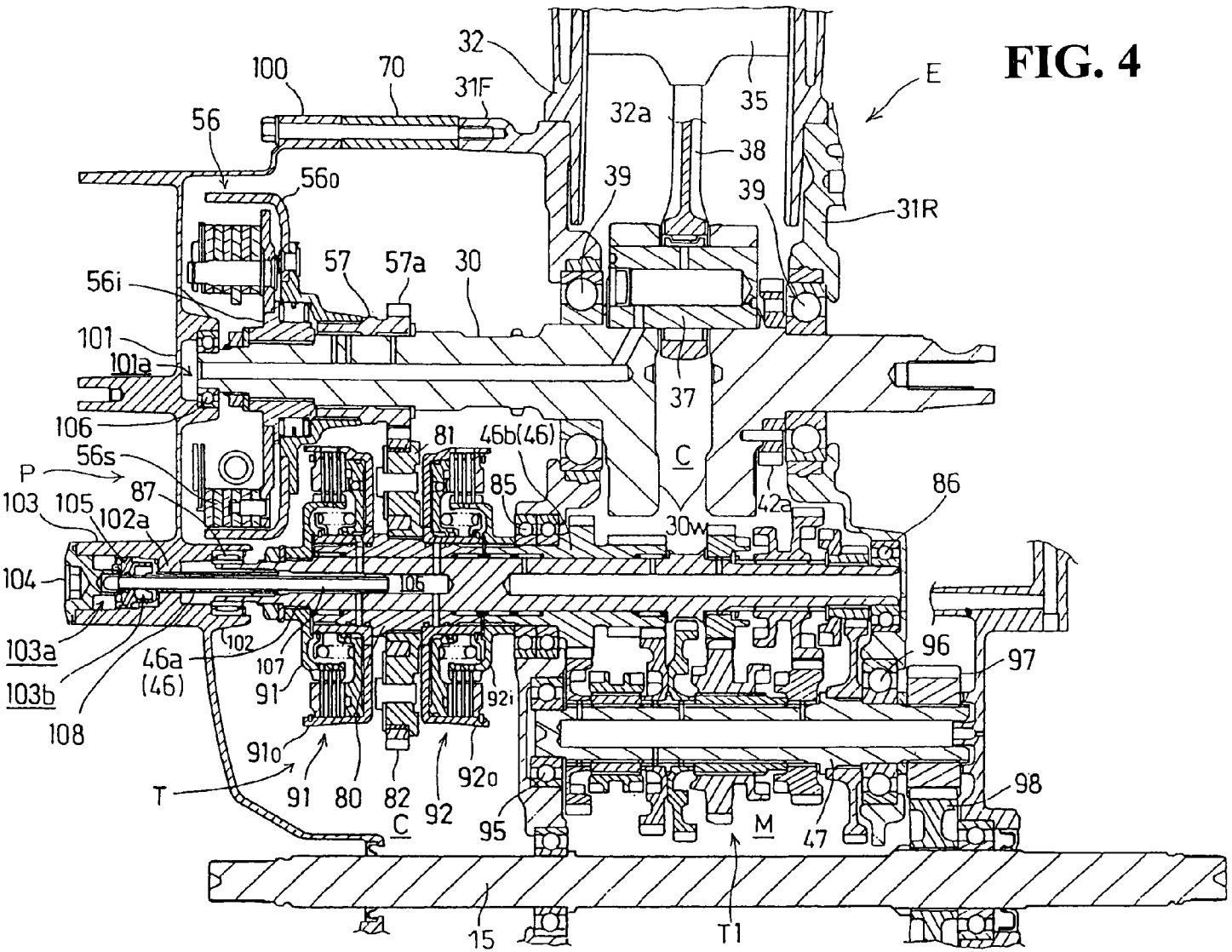
FIG. 4 is a cross-sectional view of a power transmission mechanism.
Figure 5:
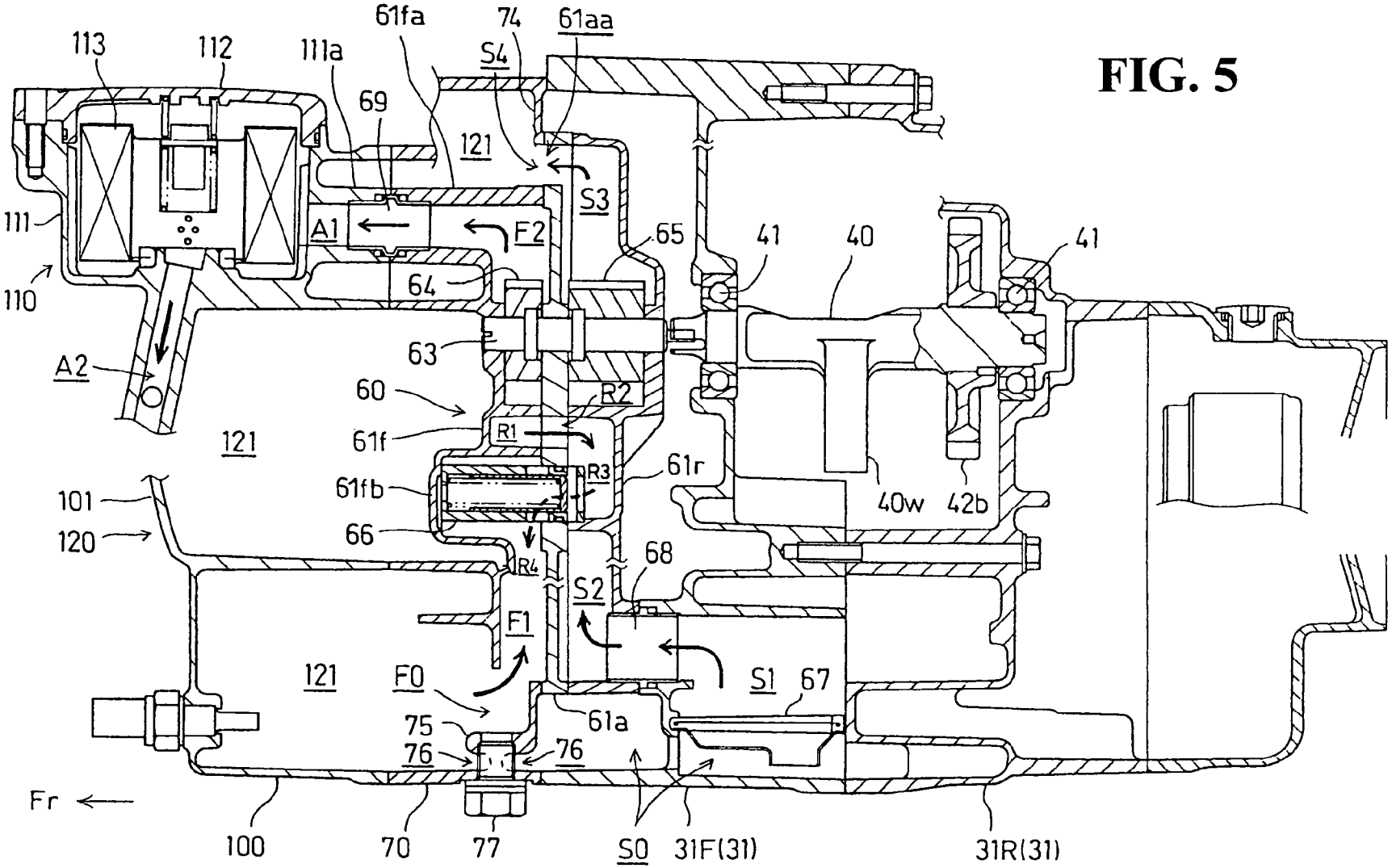
FIG. 5 is a cross-sectional view of the essential portion of a lubricating device (the cross-sectional view taken along line V-V of FIGS. 6 and 7)

FIG. 4 is a cross-sectional view of a power transmission mechanism of the internal combustion engine E and FIG. 5 is a cross-sectional view of an essential portion of a lubricating device. Referring to FIG. 4, the crankshaft 30 is rotatably supported in front and rear of the crank webs 30*w*, 30*w* by the front, crankcase 31F and the rear crankcase 31R via main bearings 39, 39.

A balancer shaft 40 is located on the right (on the left in FIG. 3) of and slightly below the crankshaft 30 so as to be parallel to the crankshaft 30. The balancer shaft 40 is rotatably supported at both ends thereof by the front crankcase 31F and the rear crankcase 31R via bearings 41, 41 as shown in FIG. 5. The balancer shaft 40 is formed with a balancer weight 40*w* at its central portion. A driven gear 42*b* is fixedly fitted to the balancer shaft 40 at its rear portion. The driven gear 42*b* meshes with a drive gear 42*a* (see FIG. 4).

A cam shaft 43 of a valve system is located on the right of and obliquely above the crankshaft 30 so as to be parallel to the crankshaft 30. The cam shaft 43 is rotatably supported at both ends thereof by the front crankcase 31F and the rear crankcase 31R. The lower end of a push rod 45 is in contact with cam lobes 43*a*, 43*b* of the cam shaft 43. The push rod 45 is adapted to transmit a driving force to the valve system in the cylinder head 33.

The transmission T is disposed on the left (on the right in FIG. 3) of the crankshaft 30. A main shaft 46, a counter shaft 47 and an intermediate shaft 48 constitute a speed-change gear mechanism. A shift drum 49 is driven to execute shifting and power is transmitted to the output shaft 15.

Referring to FIG. 4, a centrifugal start clutch 56 includes a clutch inner 56*i* serving as an input member, a bowl-like clutch outer 56*o* serving as an output member and a clutch shoe 56*s* serving as a centrifugal weight. The clutch inner 56*i* is rotated integrally with the crankshaft 30. The outer clutch outer 56*o* surrounds the clutch inner 56*i* from the radial outside. The clutch shoe 56*s* is supported by the clutch inner 56*i* and comes into contact and engagement with the clutch outer 56*o* through radially external movement. A boss portion of the clutch outer 56*o* is spline-fitted to a cylindrical gear member 57 rotatably carried by the crankshaft 30.

Power is transmitted from a primary drive gear 57*a* of the cylindrical gear member 57 to the transmission T. The main shaft 46 of the transmission T includes a first main shaft 46*a* and a second main shaft 46*b* that is partially rotatably fitted to the outer circumference of the first main shaft 46*a*. The second main shaft 46*b* is rotatably supported by the front crankcase 31F via a bearing 85. The first main shaft 46*a* is rotatably supported at its rear end by the rear crankcase 31R via a bearing 86.

An input sleeve 80 is rotatably fitted onto the first main shaft 46*a* so as to be next to and in front of the second main shaft 46*b*. A disk plate 81 is fixedly fitted to the central portion of the input sleeve 80. A primary driven gear 82 carried on the outer circumference of the disk plate 81 meshes with the primary drive gear 57.

A first shift clutch 91 and a second shift clutch 92 are disposed in front and rear, respectively, of the disk plate 81 formed integrally with the primary driven gear 82. The first and second shift clutches 91, 92 are hydraulic multi-disk friction clutches having the same structure.

The first shift clutch 91 on the font side is located adjacently to the start clutch 56 on the rear side. The bowl-like clutch outer 91*o* opening forward is integrally fixedly fitted to the front portion of the input sleeve 80. A clutch inner 92*i* is integrally fixedly fitted to the first main shaft 46*a*.

On the other hand, the second shift clutch 92 on the rear side is such that a clutch outer 92*o* formed like a bowl to be open rearward is integrally fixedly fitted to the rear portion of the input sleeve 80 and a clutch inner 92*i* is integrally fixedly fitted to a portion of the second main shaft 46 extending forward from the bearing 85.

In this way, if the first shift clutch 91 is brought into engagement and the second shift clutch 92 into disengagement, power inputted to the driven gear 83 (82) is transmitted to the first main shaft 46*a* via the first shift clutch 91. In contrast, if the first shift clutch 91 is brought into disengagement and the second shift clutch 92 into engagement, the power is transmitted to the second main shaft 46*b* via the second shift clutch 92.

The counter shaft 47 rotatably supported by bearings 95, 96 is disposed parallel to respective portions, of the first main shaft 46*a* and second main shaft 46*b*, extending in the transmission chamber M. A shift gear train group T1 that is the assemblage of gear trains setting shift stages is constructed between the portions mentioned above and the counter shaft 47 (and the intermediate shaft 48).

The gear trains of the first main shaft 46*a* via the first shift clutch 91 constitute first-speed, second-speed, and fifth-speed shift stages. The gear trains of the second main shaft 46*b* via the second shift clutch 92 constitute second-speed, fourth-speed and reverse shift stages.

A drive gear 97 is fixedly fitted to the rear end of the counter shaft 47, which projects rearward from the rear crankcase 31R. The drive gear 97 meshes with a driven gear 98 fixedly fitted to the output shaft 15 disposed parallel to the counter shaft 47. Thus, the power reduced in speed is transmitted to the output shaft 15.

The shift drum 49 is turnably spanned between the front crankcase 31F and the rear crankcase 31R. The shift pins of shift forks 50*a*, 50*b*, 50*c* slidably carried by the guide shaft 50 are fitted into three shift grooves formed on the outer circumferential surface of the shift drum 49. The shift drum 49 is turned to axially move the shift fork 50*a* by being guided by the shift grooves. The shift fork 50*a* moves the gears on the main shaft 46 and the shift forks 50*b*, 50*c* move the gears on the counter shaft 47. Thus, a set of meshing shift gears is changed.

The rear mating surface of the front crankcase 31F is superposed on and fastened to a front mating surface 31Rf of the rear crankcase 31R shown in FIG. 3. The crank webs 30*w* of the crankshaft 30, the balancer weight 40*w* of the balancer shaft 40, the cam lobes 43*a*, 43*b* of the cam shaft 43 and the shift gear train group T1 are housed inside, thus, constructing the crankcase 31. A front case cover 100 is put on the front case 31F from the front via a spacer 70.

The spacer 70 is an extending member obtained by forwardly extending the front surface circumferential edge portion of the front crankcase 31F. This spacer 70 is formed with the oil pump unit 60 of the dry sump type lubricating system and with part of the oil tank 120.

Figure 6:
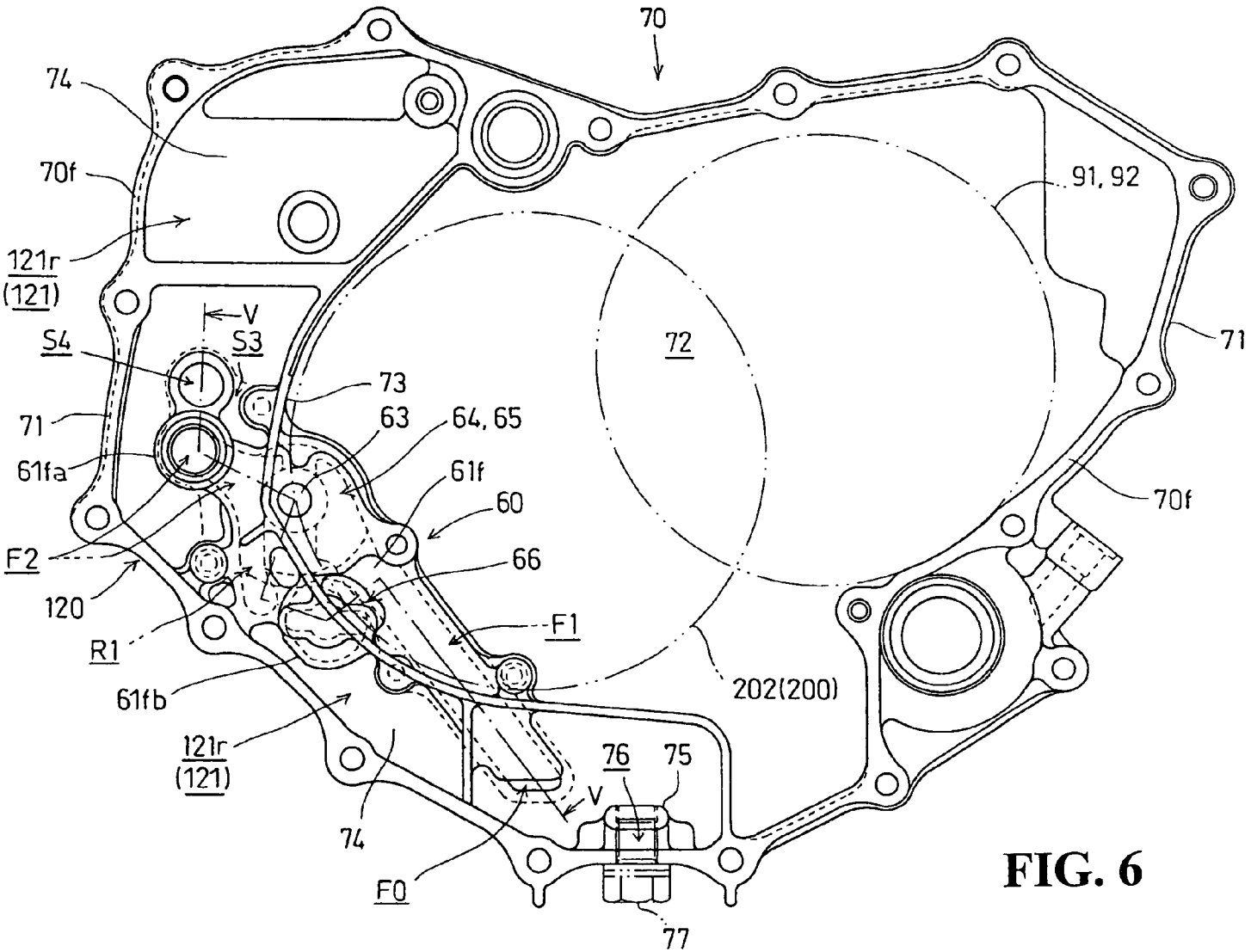
FIG. 6 is a front view of a spacer (crankcase extension member)
Figure 7:
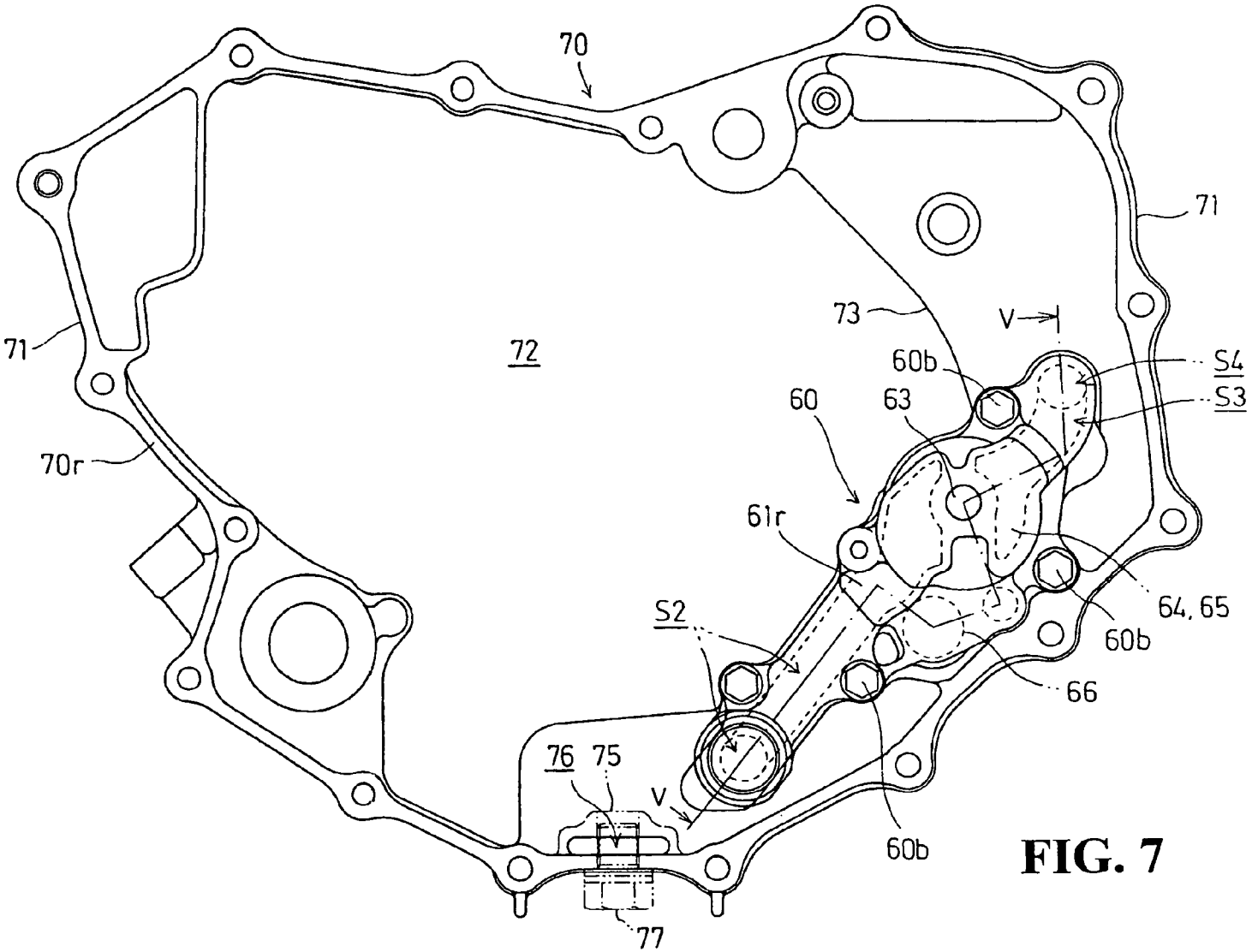
FIG. 7 is a rear view of the spacer.

FIG. 6 is a front view of the spacer 70 and FIG. 7 is a rear view of the spacer 70. The spacer 70 is adapted to connect the front crankcase 31F with the front case cover 100. In addition, the spacer 70 is an annular member, which has front and rear mating surfaces 70*f*, 70*r* on its outer circumferential wall 71 and which has a left-right width greater than an up-down width. The outer circumferential wall 71 is internally partitioned by an arcuate partition wall 73 extending along the right portion (the left portion in FIG. 6) of the curved outer circumferential wall 71 to define a large cavity, which is a portion of the crank chamber C on the left side (the right side) of the partition wall 73.

A division wall 74, which is a vertical wall, connects the right portion of the outer circumferential wall 71 with the partition wall 73. The division wall 74 is adapted to partition the crank chamber from an oil tank chamber 121. A recess portion 121*r* is defined by the outer circumferential wall 71 and the partition wall 73 so as to be formed arcuately elongate and be open forwardly. Thus, a rear portion of the oil tank chamber 121 is formed by the recess portion 121*r* and the division wall 74 used as a bottom wall.

The spacer 70 is substantially partitioned by the partition wall 73 to provide a left side cavity 72. The crankshaft 30 and main shaft 46 pass through the cavity 72 and in particular the first and second shift clutches 91, 92 carried by the main shaft 46 are housed in the cavity 72. The partition wall 73 is formed almost arc-circular so as to extend along the clutch outer 56*o* of the start clutch 56 installed on the front end of the main shaft 46.

In this way, the elongate recess portion 121*r* is defined between the outer circumferential wall 71 and partition wall 73 to form the rear portion of the oil tank chamber 121. In addition, the recess portion 121*r* extends upwardly-downwardly arcuately from the upper portion of the outer circumferential wall 71 to the lowermost portion while being partitioned from the cavity 72 (the crank chamber C) by the partition wall 73.

The front case cover 100 covered on the spacer 70 from the front is formed with an arcuate recess portion opposed to the elongate arcuate recess portion 121*r* of the spacer 70. Thus, both the arcuate recess portions are joined together to form the oil tank chamber 121. The oil in the oil tank chamber 121 smoothly flows downwardly along the inclining inner surface of the outer circumferential wall of the arcuate recess portion. The division wall 74 along with a portion thereof protruding to the cavity 72 constitutes a front pump case half-body portion 61*f* of the oil pump unit 60.

That is to say, the right portion of the spacer 70 is formed forward of the division wall 74 with a recess portion 121*r*, which is a rear portion of the oil tank chamber 121, and rearward of the division wall 74 with the crank chamber C. In addition, the right portion of the spacer 70 constitutes a front pump case half-body portion 61*f* of the partial oil pump unit 60.

As shown in FIG. 5, the obliquely elongate oil pump unit 60 is configured such that a partition plate 61*a* or a pump case half-body is disposed rearward of the front pump case half-body portion 61*f*, covered by the rear pump case half-body 61*r*, put between the front pump case half-body portion 61*f* and the rear pump case half-body 61*r* and fastened thereto with bolts (see FIG. 7).

On the side of the cavity 72 extending along the partition wall 72 of the oil pump unit 60, a pump drive shaft 63 passes, in the back and forth direction, through the front pump case half-body portion 61*f*, the partition plate 61*a* and the rear pump case half-body 61*r* and is rotatably supported coaxially with the balancer shaft 40. The pump drive shaft 63 has a rear end, which further passes through the front crankcase 31F and is integrally and rotatably connected to the balancer shaft 40 (see FIG. 5).

As shown in FIG. 5, a feed pump 64 and a scavenge pump 65 are provided on the pump drive shaft 63 in front and rear, respectively, of the partition plate 61*a*. The partition plate 61*a* is a pump case half-body shared by the feed pump 64 and the scavenge pump 65. The front pump case half-body portion 61*f* of the spacer 70 and the partition plate 61*a* form a pump case for the feed pump 64. The rear pump case half-body 61*r* and partition plate 61*a* form a pump case for the scavenge pump 65.

The spacer 70 is formed with the front pump case half-body portion 61*f* of the feed pump 64 and the partition plate 61*a* serves as the pump case half-body shared by the feed pump 64 and the scavenge pump 65. Thus, the number of component parts of the oil pump unit 60 can significantly be reduced.

Between the rear pump case half-body 61*r* and partition plate 61*a*, an oil pumping passage S2 is formed to extend obliquely below the scavenge pump 65 and a tank supply oil passage S3 is formed to extend above the scavenge pump 65. The oil pumping passage S2 extending obliquely below the scavenge pump has a lower end opening rearward, which communicates with the oil pumping passage S1 in the lower portion of the front crankcase 31F through a connection pipe 68. An oil strainer 67 is interposed between the oil pumping passage S1 and an oil sump chamber S0 below the oil pumping passage S1.

The tank supply oil passage S3 extends upward and communicates with a scavenge pump discharge port 61*aa* bored in an upper end portion, of the partition plate 61*a*, protruding from the front pump case half-body portion 61*f*. The scavenge pump discharge port 61*aa* is connected to and communicates with a tank supply port S4 formed at a corresponding portion of the division wall 74 (the bottom wall of the recess portion 121*r* of the oil tank chamber 121) of the spacer 70.

The tank supply port S4 is open at the upper portion of the oil tank chamber 121. Thus, the scavenge pump 65 is driven to pump the oil collecting in the oil sump chamber S0 corresponding to the bottom portion of the crank chamber C through the oil pumping passages S1, S2, discharges it to the tank supply oil passage S3 and then supplies it to the oil tank chamber 121 through the tank supply port S4.

Alternatively, the discharge oil from the scavenge pump 65 may be supplied from the tank supply port S4 to the oil tank chamber 121 through auxiliary equipment such as an oil cooler.

As described above, the scavenge pump 65 of the oil pump unit 60 is such that the partition wall 61*a* which is a pump case half-body is bored with the scavenge pump discharge port 61*aa* and the division wall 74 of the spacer 70 is formed with the tank supply port S4 communicating with the scavenge pump discharge port 61*aa*. Thus, the discharge oil passage extending from the scavenge pump 65 to the oil tank chamber 121 is reduced in the number of the component parts for simple configuration.

On the other hand, between the front pump case half-body portion 61*f* of the spacer 70 and the partition plate 61*a*, an feed suction oil passage F1 is formed to extend obliquely below the feed pump 64 and a feed discharge oil passage F2 is formed to extend obliquely upward from the right of the feed pump 64.

A feed suction port F0 is formed at the lower portion, extending obliquely downward, of the front pump case half-body portion 61*f* constituting the feed suction oil passage F1. In addition, the feed suction port F0 is open at the bottom portion of the oil tank chamber 121 for communication therewith.

Thus, since a connecting pipe, a knock pin, an O-ring and the like are not needed, the suction oil passage extending from the oil tank chamber 121 to the feed pump 64 can be simplified to configure the simplified pump case of the feed pump 64. This can reduce the size and weight of the oil pump unit 60 including the pump case of the scavenge pump 65.

A cylindrical portion 61*fa* is formed to project forward from a portion, of the pump case half-body portion 61*f* of the spacer 70, adjacent to the downside of the tank supply port S4. The feed discharge oil passage F2 extends obliquely upward, bending forward, and communicates with the cylindrical portion 61*fa* (see FIG. 5).

Referring to FIG. 5, a filter case 111 of an oil filter 110 is formed on the right side wall of the front case cover 100 covered on the spacer 70 from the front. A cylindrical portion 111*a* forms an inflow oil passage A1 extending rearward from the filter case 111 and is connected to a cylindrical portion 74*a* on the side of the spacer 70 via a connection pipe 69. The cylindrical portion 74*a* and cylindrical portion 111*a* connected to each other through the connection pipe 69 passes through the oil tank chamber 121 in the back and forth direction.

As described above, the cylindrical portion 61*fa* of the feed discharge oil passage F2, which causes the feed pump 64 to communicate with the oil filter 110 is formed integral with the pump case half-body portion 61*f* of the spacer 70. Therefore, the number of component parts of the oil pump unit 60 can further be reduced.

A valve storage portion 61*fb* is disposed below the feed pump 64 and formed by forward protruding a portion of the pump case half-body portion 61*f*. A relief valve 66 is fitted into the valve storage portion 61*fb*. The rear end of the relief valve 66 passes through the partition plate 61*a* and extends into a valve upstream chamber R3 defined in the rear pump case half-body 61*r*.

A relief oil passage R1 is formed by downward extending a portion of the feed discharge oil passage F2. The relief oil passage R1 communicates with the valve upstream chamber R3 via a through-hole R2 bored in the partition plate 61*a*. A relief outlet R4 is formed at a portion of the valve storage portion 61*fb* on the downstream side of the relief valve 66 to open in the feed suction oil passage F1.

Thus, the feed pump 64 is driven to cause the oil in the oil tank chamber 121 to flow from the feed suction port F0 opening at the lower portion of the oil tank chamber 121, passing the feed suction oil passage F1, and be sucked therein. Then, the oil sucked is discharged to the feed suction oil passage F2, passing the inflow oil passage A1 in the cylindrical portions 61*fa*, 111*a* passing through the oil tank chamber 121 in the back and forth direction, and reaches the oil filter 110.

If the discharged oil pressure exceeds a predetermine value, the relief valve 66 is opened to allow a portion of the discharged oil to return from the feed discharge oil passage F2 to the feed suction oil passage F1 through the relief oil passage R1, the valve upstream chamber R3 and the relief outlet R4.

Referring to FIGS. 6 and 7, the bottom wall of the spacer 70 is inclined obliquely downwardly from the left and right to the center thereof. A bolt boss portion 75 is formed at the lowest position of the center of the bottom wall so as to protrude in the oil tank chamber 121. The bolt boss portion 75 is vertically bored with a bolt hole adapted to receive a drain bolt 77 threaded thereto from below. In addition, the bolt boss portion 75 is bored with a drain hole 76 which passes therethrough in the back and forth direction so as to intersect the bolt hole and to cause the bottom portion of the oil tank chamber 121 to communicate with the oil sump chamber S0 of the bottom portion of the crank chamber C.

Thus, if being threaded to the bolt boss portion 75 from the downside of the spacer 70, the drain bolt 77 can close the bottom wall while partitioning the bottom portion of the oil tank chamber 121 from the bottom portion of the crank chamber C. If the drain bolt 77 is removed, the oil can be drained from both the oil tank chamber 121 and the crank chamber C.

The front case cover 100 covered on the spacer 70 from the front includes a front wall 101, which is disposed inside the annular mating surface opposed to the front mating surface 70*f* of the spacer 70, so as to be formed to protrude forward. The arcuate recess portion forming the oil tank chamber 121 as described above is formed on the right side portion of the front wall 101. The start clutch 56, the first shift clutch 91 and the like are accommodated in the protruding space excluding the arcuate recess portion (see FIG. 4).

As shown in FIG. 4, the front wall 101 of the front case cover 100 is formed projecting inwardly with a bearing hole 101*a*, a bearing cylindrical portion 102, etc. The bearing hole 101*a* rotatably supports the front end of the crankshaft 30 via a bearing 106. The bearing cylindrical portion 102 rotatably supports the front end of the first main shaft 46*a* via a bearing 87.

The bearing cylindrical portion 102 extends outwardly to form an external cylindrical portion 103. The external cylindrical portion 103 is internally partitioned from the inside of the bearing cylindrical portion 102 by the partition wall 102*a*. The external cylindrical portion 103 has a front end opening, which is closed by a lid member 104 to define an internal space. This internal space is partitioned by a partitioning member 105 into a front chamber 103*a* and a rear chamber 103*b*.

On the other hand, the first main shaft 46*a* is bored in its front portion with a shaft hole 106 extending from the front end thereof to a position corresponding to the second shift clutch 92. A long conduction inner tube 107 is inserted from the front chamber 103*a* into the shaft hole 106 so as to pass through the partition member 105. The conduction inner tube 107 is disposed to reach an intermediate position between the first shift clutch 91 and the second shift clutch 92. In addition, the rear end of the conduction inner tube 107 is supported in the shaft hole 106 by the seal member 107*a*.

A short conduction outer tube 108 is disposed coaxially with the conduction inner tube 107 and on the outer circumference of the conduction inner tube 107. The conduction outer tube 108 is fitted at its front end into the partition wall 102*a*, is inserted into the shaft hole 106, and is supported at its rear end by a seal member 108*a*.

Hydraulic pressure is supplied to the front chamber 103*a* and rear chamber 103*b* of the external cylindrical portion 103 from a hydraulic control unit 160.

If being supplied to the rear chamber 103*b*, the hydraulic pressure passes between the shorter conduction outer tube 108 and the conduction inner tube 107 and is supplied to the first shift clutch 91 from the front of the seal member 107*a*, thereby bringing the first shift clutch 91 into engagement.

If being supplied to the front chamber 103*a*, the hydraulic pressure passes through the longer conduction inner tube 107 and is supplied to the second shift clutch 92 from the shaft hole 106 rearward of the seal member 107*a*, thereby bringing the second shift clutch 92 into engagement.

Shifting is smoothly executed by the hydraulic control valve unit 160 controlled to alternately switch between the shift stages of the first-speed, third-speed and fifth-speed of the gear train on the first main shaft 46*a* via the first shift clutch 91 described above and the shift gears of the second-speed, fourth-speed and reverse of the gear train on the second main shaft 46*b* via the second shift clutch 92.

As shown in FIG. 5, a filter element 113 is inserted into the filer case 111 formed on the right-side wall of the front case cover 100 and is covered by the filter cover 112 from the right, thus constituting the oil filter 110.

The oil discharged from the feed pump 64 is allowed to flow into the filter case 111 from the suction oil passage A1 extending rearward from the filter case 111. An outflow oil passage A2 extends from the center of the bottom wall of the filter case 111 along the front wall 101 of the front case cover 100.

Figure 8:
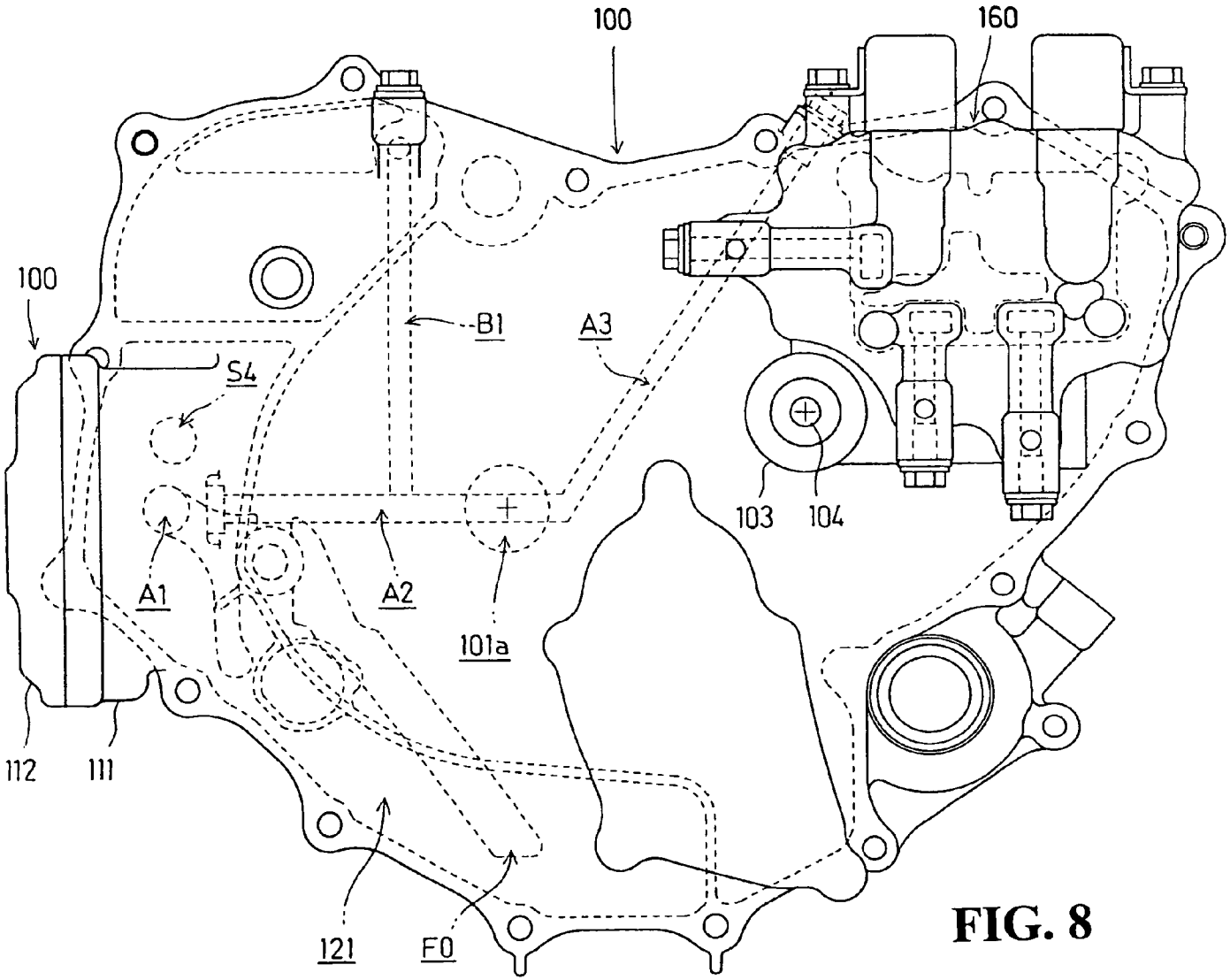
FIG. 8 is a front view of a front case cover.

Referring to FIG. 8, the outflow oil passage A2 communicates with the bearing hole 101*a* to lubricate the bearing 110. The bearing hole 101*a* is adapted to rotatably support the front end of the crankshaft 30 via the bearing 110. An oil supply passage A3 continuous with the outflow oil passage A2 extends obliquely upward from the bearing hole 101*a* and communicates with the hydraulic control valve unit 160 disposed on the upper-left portion of the front wall 101 for oil supply.

In addition, another oil supply passage B1 braches from the intermediate portion of the outflow oil passage A2 and extends upward for supplying oil to the cylinder head 32.

The hydraulic control valve unit 160 is disposed adjacently to the external cylindrical portion 103 coaxial with the bearing cylindrical portion 102 which rotatably supports the main shaft 46 carrying the first and second shift clutches 91, 92 thereon. The hydraulic control valve unit 160 controls hydraulic pressure to be supplied to the front chamber 103*a* and rear chamber 103*b* of the external cylindrical portion 103 which controls the engagement and disengagement of each of the first and second shift clutches 91, 92.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil pump unit for an internal combustion engine, comprising:

a case cover on an outside of a crankcase via a spacer, an oil tank chamber being formed by an inside surface of the case cover and the spacer, wherein the spacer is formed inside an outer circumferential wall thereof with a division wall that partitions the oil tank chamber from a crank chamber and with a pump case half-body portion, which is a portion of a pump case for an oil pump, a pump case half-body is joined to the pump case half-body portion to form the pump case, and the pump case half-body portion is formed in a lower portion thereof with an oil suction port in communication with a bottom portion of the oil tank chamber, wherein the pump case half body is used as a partition plate, the pump case half-body portion of the spacer is joined to one lateral surface of the partition plate to form the pump case of the oil pump, a second pump case half-body is joined to the other lateral surface of the partition plate to form a second pump case of a second oil pump, and wherein a portion of the pump case half-body which forms the second pump case together with the second pump case half-body and which protrudes from the pump case half-body portion is bored with a second oil pump discharge port of the second oil pump, and the division wall of the spacer is formed with a tank supply port in communication with the second oil pump discharge port.

2. An oil pump unit for an internal combustion engine, comprising:

a case cover on an outside of a crankcase via a spacer, an oil tank chamber being formed by an inside surface of the case cover and the spacer, wherein the spacer is formed inside an outer circumferential wall thereof with a division wall that partitions the oil tank chamber from a crank chamber and with a pump case half-body portion, which is a portion of a pump case for an oil pump, a pump case half-body is joined to the pump case half-body portion to form the pump case, and the pump case half-body portion is formed in a lower portion thereof with an oil suction port in communication with a bottom portion of the oil tank chamber, and wherein the pump case is a first pump case for a feed pump, the oil pump unit further comprising a second pump case for a scavenging pump, the second pump case being formed between the pump case half-body and another pump case half-body portion located on a side of the case half-body opposite to the pump case half-body portion for the feed pump.

3. An oil pump unit for an internal combustion engine, comprising:

a crankcase;

a spacer mounted on a front of the crankcase, said spacer including a division wall and a first pump case wall;

a case cover mounted on a front of the spacer, an oil tank chamber being formed by an inside surface of the case cover and the division wall;

a second pump case wall joined to the first pump case wall to form a pump case, wherein the first pump case wall is formed in a lower portion thereof with an oil suction port in communication with a bottom portion of the oil tank chamber; and a third pump case wall, the first pump case wall is joined to one lateral surface of the second pump case wall to form a first pump case of a first oil pump, the third pump case wall is joined to another lateral surface of the second pump case wall to form a second pump case of a second oil pump, wherein a portion of the second pump case wall, which forms the second pump case together with the third pump case wall, and which protrudes from the first pump case wall, is bored with a second oil pump discharge port of the second oil pump, and the division wall of the spacer is formed with a tank supply port in communication with the second oil pump discharge port.

4. An oil pump unit for an internal combustion engine, comprising:

a crankcase;

a spacer mounted on a front of the crankcase, said spacer including a division wall and a first pump case wall;

a case cover mounted on a front of the spacer, an oil tank chamber being formed by an inside surface of the case cover and the division wall; and a second pump case wall joined to the first pump case wall to form a pump case, wherein the first pump case wall is formed in a lower portion thereof with an oil suction port in communication with a bottom portion of the oil tank chamber, and wherein the pump case is a first pump case for a feed pump, the oil pump unit further comprising a second pump case for a scavenging pump, the second pump case being formed between the second pump case wall and a third pump case wall located on a side of the second pump case wall opposite to the first pump case wall for the feed pump.

* * * * *